US009017134B1

(12) United States Patent
Christian

(10) Patent No.: US 9,017,134 B1
(45) Date of Patent: Apr. 28, 2015

(54) ASSEMBLY KIT FOR CREATING THREE-DIMENSIONAL FORMATIONS, ESPECIALLY TOY STRUCTURES FROM PREFABRICATED MODULAR BUILDING BLOCKS

(71) Applicant: Reinar Carl Christian, Rancho Cucamonga, CA (US)

(72) Inventor: Reinar Carl Christian, Rancho Cucamonga, CA (US)

( * ) Notice: Subject to any disclaimer, the term of this patent is extended or adjusted under 35 U.S.C. 154(b) by 0 days.

(21) Appl. No.: 13/932,511

(22) Filed: Jul. 1, 2013

(51) Int. Cl.
*A63H 33/08* (2006.01)
*A63H 33/04* (2006.01)

(52) U.S. Cl.
CPC ..... *A63H 33/04* (2013.01)

(58) Field of Classification Search
CPC ..... A63H 33/08; A63H 33/04
USPC ..... 446/124
See application file for complete search history.

(56) References Cited

U.S. PATENT DOCUMENTS 4,381,619 A * 5/1983 Griffin ..... 446/125
5,378,185 A * 1/1995 Ban ..... 446/124
5,391,103 A * 2/1995 Mak ..... 446/125
5,826,394 A * 10/1998 Barton et al. ..... 52/592.1
D605,236 S * 12/2009 Sinisi et al. ..... D21/502

* cited by examiner

*Primary Examiner* — Michael Dennis

(74) *Attorney, Agent, or Firm* — MU Patents; Timothy Marc Shropshire

(57) ABSTRACT

An improved set of toy building or construction blocks, each block having a substantially square cross-section and a generally rectilinear configuration. Incorporated into the structure of the individual toy blocks are transversely oriented slots, grooves and protrusions of predetermined size and location. The slots, grooves and protrusions of pre-determined size and location are of either male or female configuration disposed medially along one or more plane of each block. When the male protrusion of one block is introduced perpendicular to the female slot of one end of another block, a frictional engagement is created resulting in a right angle. When the male protrusion of one block is introduced to the female slot in a linear fashion the result is a line segment. Joining a plurality of said toy building or construction blocks using various perpendicular connections in conjunction with linear connections results in the stable formation of construction or geometric structures without the use of fasteners or other connecting elements.

12 Claims, 4 Drawing Sheets

ASSEMBLY KIT FOR CREATING THREE-DIMENSIONAL FORMATIONS, ESPECIALLY TOY STRUCTURES FROM PREFABRICATED MODULAR BUILDING BLOCKS

BACKGROUND

Prior Art

The following is a tabulation of some prior art that appears relevant.

| U.S. Patents | | |
|---|---|---|
| Patent Number | Issue Date | Patentee |
| 3,811,219 | May 21, 1974 | Artur Fischer |
| 6,059,631 | May 12, 2004 | Paul Thomas Maddock |
| 3,660,928 | Mar. 9, 1972 | Elizabeth Sharon Carpenter |
| 2,278,327 | Mar. 31, 1942 | L. Magnus |

| Foreign Application | | |
|---|---|---|
| Application Number | Publication Date | Applicant |
| EP2340882A1 | Jun. 6, 2011 | Sixten Heidmets |

Toy blocks have been made for children as long as humans have been able to manipulate the structure of natural elements. In recent years assembly kits comprising wood and/or plastic building blocks have appeared on the market; all useful and intelligently contrived, yet all with limitations. In order to attract and maintain a child's interest, a substantial structure should be erected with as few building blocks as possible. The structure should maintain stability during and after erection, then assemble and disassemble quickly and easily; without breakage or deformation of the individual building blocks.

The object of the present embodiment is to provide a toy building kit directed primarily at allowing a wide variety of structures of reasonably life-like appearance and a plurality of geometric shapes to be constructed while using simple near real-life construction methods.

Prior art provides various elements or blocks of connectable members suitable for building structures. For example, the toy blocks in application EP 2340882A1, published Jun. 6, 2011, are of unique design made from a soft material appropriate for infants as stated (summary 0005), and a multitude of these toy blocks would be necessary to accomplish a structure suitable to keep the interest of a small child.

The ability of a child to build a structure vertically in addition to horizontally seems imperative to maintaining that child's interest by way of novelty. In the example disclosed as U.S. Pat. No. 3,660,928 patented Mar. 9, 1972, the point as described is realized.

U.S. Pat. No. 3,811,219 patented May 21, 1974 is another example that discloses at least two elongated structural elements of, e.g., T-shape or U-shape. The structural elements have spaced opposite ends, each of which has a flange extending transversely to the elongation of the respective element. Connecting means is provided at least on the axially outer sides of the respective flanges.

Another example is U.S. Pat. No. 6,059,631 issued May 12, 2004 and discloses an attractive arrangement that, due to the complexity of the structures, manufacturing processes would be limited, and the finished products would have difficulty resembling true-to-life structures.

Each block has a tongue or groove at its respective extreme end. The tongue fits into the groove as to mate by means of frictional engagement. Each block also has at least one groove or slot situated along the median plane of each block whereas a corresponding tongue or groove from an opposing block can mate by means of frictional engagement.

ADVANTAGES

Accordingly, several advantages of one or more aspects are as follows: The embodiment described herein allows a person, especially a child to build a structure or shape horizontally and vertically providing an unlimited range of variety. Due to the contemplated size of the individual building blocks, few are needed to produce a structure or shape of impressive size.

In part, the design of the toy blocks described in this embodiment is to, during assembly, mimic that of real construction methods, teaching the true nature of simple weight supporting, and weight sustaining structures.

As the inventor of the toy blocks described herein, I feel a desire to transition away from the complicated electronic, or multifunction plastic toys, back to children's toys that inspire imagination, strategic thinking and offers the child the opportunity to build their own creation.

SUMMARY

The present embodiment represents a set of toy building or construction blocks, all having specifically located slots, grooves and protrusions. The purpose of said slots, grooves and protrusions is to provide, by frictional engagement, an interlocking system whereby a plurality of toy building or construction blocks can be used to build a variety of stable shapes and structures.

DRAWINGS REFERENCE NUMERALS

10. Female slot or groove at extreme end of building block of appropriate thickness and width and depth to accept a male protrusion or tongue (11) providing frictional engagement between the two.

11. Male protrusion or tongue at extreme end of building block of appropriate thickness and width and depth to accept a female slot or groove (10) providing frictional engagement between the two.

12. Male protrusion or tongue at longitudinal center of building block of appropriate thickness and width and depth to accept a female slot or groove (10) providing frictional engagement between two or more building blocks.

13. Male protrusion or tongue on longitudinal plane off-center on building block, of appropriate thickness and width and depth to accept a female slot or groove (10) providing frictional engagement between two or more building blocks.

14. Female slot or groove on longitudinal plane off-center on building block, of appropriate thickness and width and depth to accept a male protrusion or tongue (11) providing frictional engagement between two or more building blocks.

DETAILED DESCRIPTION

FIGS. 1-6

Figure 1:
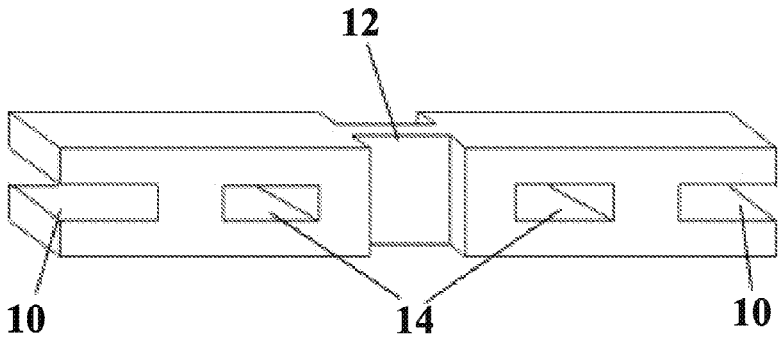
FIG. 1 is a perspective view of type 1 of 6 types of a singular toy block
Figure 2:
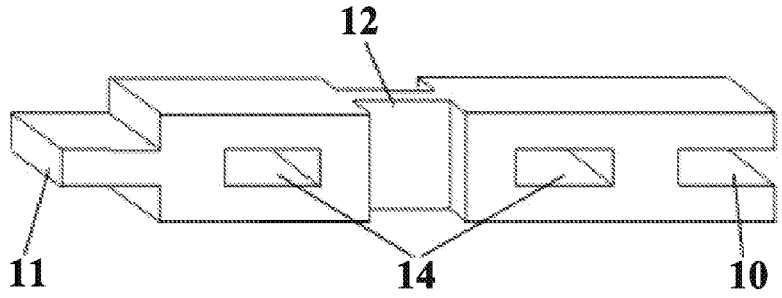
FIG. 2 is a perspective view of type 2 of 6 types of a singular toy block.
Figure 3:
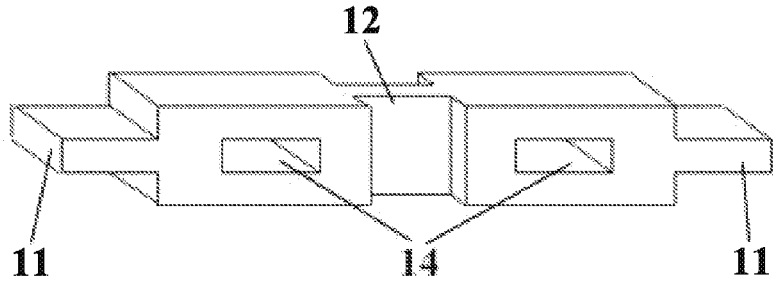
FIG. 3 is a perspective view of type 3 of 6 types of a singular toy block.
Figure 4:
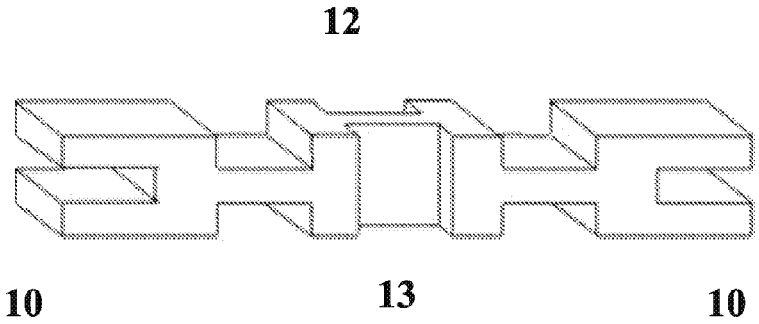
FIG. 4 is a perspective view of type 4 of 6 types of a singular toy block.
Figure 5:
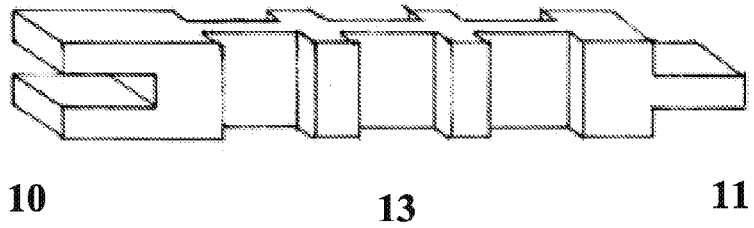
FIG. 5 is a perspective view of type 5 of 6 types of a singular toy block.
Figure 6:
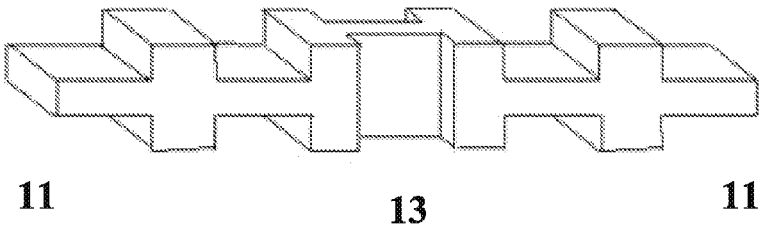
FIG. 6 is a perspective view of type 6 of 6 types of a singular toy block.
Figure 7:
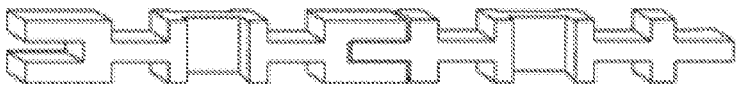
FIG. 7 is a perspective view of two modular toy blocks joined in a linear fashion as described in abstract section of this embodiment.
Figure 8:
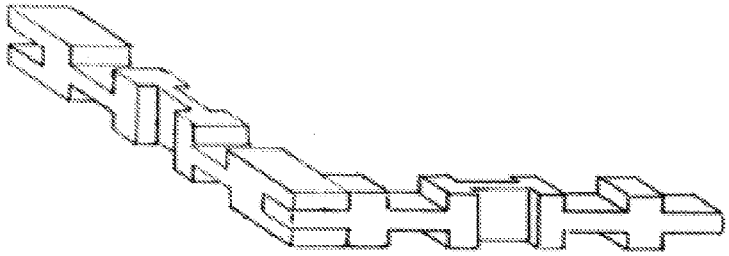
FIG. 8 is a perspective view of two modular toy blocks engaged in a perpendicular fashion creating a 90 degree angle as described in the abstract section of this embodiment.
Figure 9:
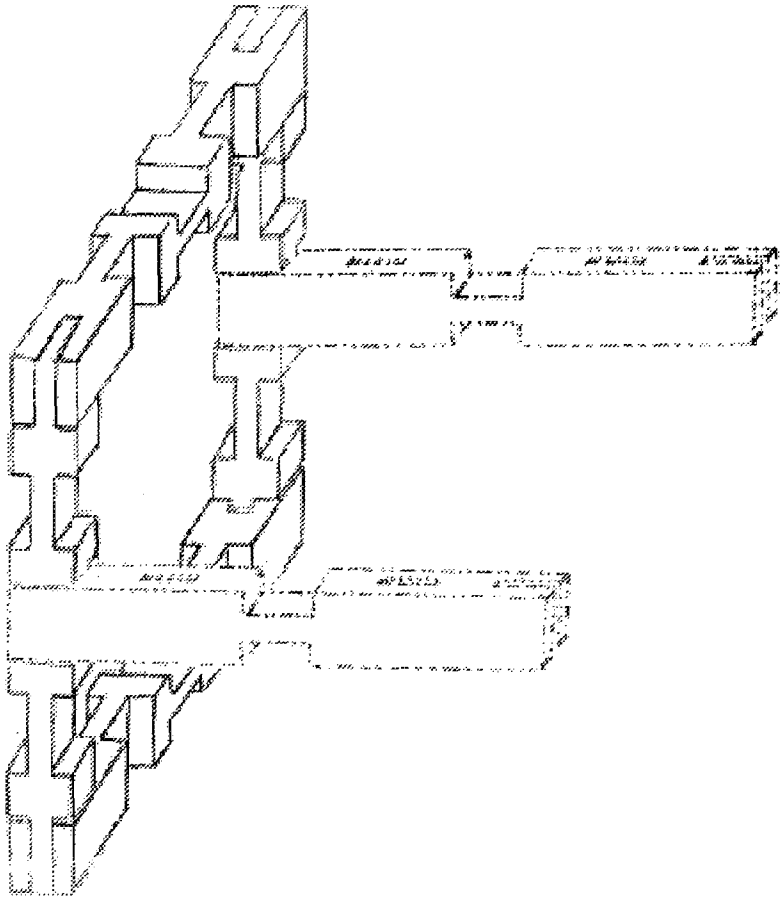
FIG. 9 is a perspective view of four modular toy blocks engaged creating a stable base additionally showing the ability to build vertically.

Each of the six toy blocks of the set described herein has on either end a male or female connection point. At the center of each block is another connection point, male type, and is positioned transversely opposite that of the end connection points. Between the center connection point and the end connection point of each of the six blocks is yet another connection point. This median connection point is either male or female but is transversely opposite of that of the center connection point, except in FIG. 5 where the orientation is the same. Because of the wide variety of connection points, multi-dimensional structures can be assembled quickly creating a safe, stable platform, and disassembled as rapidly.

I claim:

1. An elongated toy building block comprising: a. a center male connection point located at the center of the block, comprising a narrow portion having a certain thickness; b. a first end connection point at a first end of the block; c. a second end connection point at a second end of the block; d. a first off-center connection point disposed between the first end and center, and a second off-center connection point disposed between the second end and center, each off-center connection point comprising apertures configured to receive a male protrusion and frictionally engage the protrusion, wherein engagement between the connection points and mating connection points of additional blocks is accomplished using a friction fit wherein the mating connection points are not engaged by an angled corner abutment, and wherein the elongated toy building block is configured as a single-piece construction, incapable of being disassembled into smaller component parts; wherein the first end connection and second end connection are transversely opposite to the center connection point.

2. The block of claim 1, wherein the first end connection and second end connection are male connections comprising a protrusion having the certain thickness.

3. The block of claim 1, wherein the first end connection and second end connection are female connections, the female connection comprising first and second protrusions defining a space therebetween, the space having the certain thickness and configured to receive a male connection with a friction fit.

4. The block of claim 1, wherein the first end connection is a male connection comprising a protrusion having the certain thickness, and the second end connection is a female connection, the female connection comprising first and second protrusions defining a space therebetween, the space having the certain thickness and configured to receive a male connection with a friction fit.

5. The block of claim 1, wherein the block has a square cross-section and rectilinear configuration.

6. An elongated toy building block comprising: a. a center male connection point located at the center of the block, comprising a central narrow portion having a certain thickness; b. a first end connection point at a first end of the block; c. a second end connection point at a second end of the block; d. a first off-center connection point disposed between the first end and center, and a second off-center connection point disposed between the second end and center, each off-center connection point comprising a off-center narrow portion having the certain thickness, wherein engagement between the connection points and mating connection points of additional blocks is accomplished using a friction fit wherein the mating connection points are not engaged by an angled corner abutment, and wherein the elongated toy building block is configured as a single-piece construction, incapable of being disassembled into smaller component parts; wherein the first end connection and second end connection are transversely opposite to the center connection point.

7. The block of claim 6 wherein the off-center connection point is configured to accept a female connection of another block, the female connection comprising first and second protrusions defining a space therebetween.

8. The block of claim 6 wherein the first end connection and second end connection are male connections comprising a protrusion having the certain thickness.

9. The block of claim 6, wherein the first end connection and second end connection are female connections, the female connection comprising first and second protrusions defining a space therebetween, the space having the certain thickness and configured to receive a male connection with a friction fit.

10. The block of claim 6, wherein the first end connection is a male connection comprising a protrusion having the certain thickness, and the second end connection is a female connection, the female connection comprising first and second protrusions defining a space therebetween, the space having the certain thickness and configured to receive a male connection with a friction fit.

11. The block of claim 6, wherein the first off-center connection point and the second off-center connection point are oriented perpendicularly to the center male connection point.

12. The block of claim 6, wherein the first off-center connection point and the second off-center connection point are oriented parallel to the center male connection point.

* * * * *